US011554069B1

(12) United States Patent
Langmacher

(10) Patent No.: US 11,554,069 B1
(45) Date of Patent: Jan. 17, 2023

(54) STRETCHING BELT FOR STRETCHING OF THE SPINE

(71) Applicant: Tom John Langmacher, Washougal, WA (US)

(72) Inventor: Tom John Langmacher, Washougal, WA (US)

(73) Assignee: Tom John Langmacher, Washougal, WA (US)

( * ) Notice: Subject to any disclaimer, the term of this patent is extended or adjusted under 35 U.S.C. 154(b) by 300 days.

(21) Appl. No.: 16/693,004

(22) Filed: Nov. 22, 2019

(51) Int. Cl.

| | |
|---|---|
| ***A61H 1/02*** | (2006.01) |
| ***A63B 7/00*** | (2006.01) |
| ***A63B 21/068*** | (2006.01) |
| ***A63B 21/00*** | (2006.01) |

(52) U.S. Cl.
CPC ..... *A61H 1/0229* (2013.01); *A63B 7/00* (2013.01); *A61H 2201/0123* (2013.01); *A61H 2201/1269* (2013.01); *A61H 2201/1284* (2013.01); *A61H 2201/1621* (2013.01); *A61H 2201/1652* (2013.01); *A61H 2203/0487* (2013.01); *A63B 21/068* (2013.01); *A63B 21/4009* (2015.10); *A63B 21/4023* (2015.10); *Y10T 24/4086* (2015.01); *Y10T 24/4091* (2015.01); *Y10T 24/4093* (2015.01); *Y10T 24/4755* (2015.01); *Y10T 24/4764* (2015.01)

(58) Field of Classification Search
CPC ..... A61H 1/0218; A61H 1/0229; A61H 2201/1652; A41F 1/008; A41F 9/02; A41F 9/025; A41F 11/06; A41F 19/00; Y10T 24/4086; Y10T 24/4091; Y10T 24/4093; Y10T 24/4755; Y10T 24/4764; A63B 7/00; A63B 21/4023; A63B 21/068; A63B 21/4009; A41D 2200/10; A61F 5/04; A61F 5/01; A61F 5/05825; A61F 5/02; A61F 5/03; F16M 13/02
USPC ..... 601/55, 58; 294/82.11; 24/197, 265 H; 602/33, 35
See application file for complete search history.

(56) References Cited

U.S. PATENT DOCUMENTS

| | | | | | |
|---|---|---|---|---|---|
| 165,333 | A * | 7/1875 | Jackson | A44B 11/24 | 24/165 |
| 479,026 | A * | 7/1892 | Smeal | A44B 11/24 | 24/165 |
| 1,485,266 | A * | 2/1924 | Hennah | D06F 55/00 | 24/570 |
| 2,154,831 | A * | 4/1939 | Booharin | A61H 11/00 | 15/222 |
| 2,691,787 | A * | 10/1954 | Rosenwein | A47K 7/022 | 15/118 |
| 2,807,815 | A * | 10/1957 | Mack | A47K 7/022 | 15/118 |

(Continued)

*Primary Examiner* — Justine R Yu
*Assistant Examiner* — Alexander Morales
(74) *Attorney, Agent, or Firm* — Plager Schack LLP; Mark H. Plager; Kara Verryt

(57) ABSTRACT

A stretching device for stretching and aligning a user's back may include a belt, optionally a gambrel and universal hook, and optionally a support system, such as a slotted door mount. The belt may be designed to wrap around the user's back and under the user's armpits, wherein the belt is a segmented belt having a plurality of raised segments spaced along a length of the belt. Rings may be attached to each end of the belt, wherein the rings may be designed to engage with a mounting device, such as the gambrel and universal hook.

13 Claims, 4 Drawing Sheets

(56) References Cited

U.S. PATENT DOCUMENTS 2,919,134 A * 12/1959 Zuro ..... A63B 21/04 482/129
3,707,022 A * 12/1972 Diehl ..... F16G 11/143 188/65.5
4,050,693 A * 9/1977 Lichterman ..... A63B 21/1627 482/87
4,567,628 A * 2/1986 Prete, Jr. ..... A44B 11/14 24/68 CD
4,751,770 A * 6/1988 Kawahara ..... F16G 11/12 24/69 ST
4,991,573 A * 2/1991 Miller ..... A61F 5/028 128/99.1
5,148,563 A * 9/1992 Klearman ..... A61G 5/1091 128/869
5,158,510 A * 10/1992 Lemire ..... A63B 21/4001 52/74
5,168,576 A * 12/1992 Krent ..... A41D 13/0156 2/463
5,436,810 A * 7/1995 Sutherland ..... F21S 9/02 24/71 ST
5,871,424 A * 2/1999 Conner ..... A63B 21/0552 482/129
6,390,523 B2 * 5/2002 Fujikawa ..... B66D 3/22 294/82.11
7,004,695 B1 * 2/2006 Wen-Hsiang ..... B60P 7/0823 410/23
7,322,074 B2 * 1/2008 Takeuchi ..... B63C 11/22 24/71 ST
7,712,191 B2 * 5/2010 Huang ..... A44B 11/065 24/68 CD
8,915,384 B2 * 12/2014 Immerman ..... A47G 25/0614 211/119
9,517,173 B1 * 12/2016 Langmacher ..... A01K 85/14 43/42.22
9,629,776 B2 * 4/2017 Nilsson ..... A47G 25/0614 211/119
10,751,565 B2 * 8/2020 Saadallah ..... A63B 21/0724
10,905,269 B2 * 2/2021 Johansson ..... A63B 21/0724
2004/0128802 A1 * 7/2004 Templeton ..... B60P 7/083 24/68 CD
2005/0113221 A1 * 5/2005 Dovner ..... A63B 21/0004 482/121
2005/0113729 A1 * 5/2005 Scott ..... A61F 13/085 602/19
2005/0279009 A1 * 12/2005 Gironda ..... A01K 85/14 43/42.22
2007/0185527 A1 * 8/2007 Babaev ..... A61B 17/1325 606/204
2012/0252338 A1 * 10/2012 VerWys ..... A22B 5/06 452/189
2014/0188024 A1 * 7/2014 Cox ..... A61F 13/102 602/20
2014/0200499 A1 * 7/2014 Champion ..... A63B 21/1663 602/36
2015/0282974 A1 * 10/2015 Kamenaga ..... A61F 5/0193 602/19
2015/0305914 A1 * 10/2015 Wu ..... A61L 15/12 602/7
2016/0206448 A1 * 7/2016 Klutts ..... A61F 5/01
2018/0071574 A1 * 3/2018 Reder ..... A63B 21/1663 602/36
2019/0231577 A1 * 8/2019 Okamoto ..... A47G 25/14
2019/0261970 A1 * 8/2019 Parthasarathy .... A63B 21/4001 52/74

* cited by examiner

STRETCHING BELT FOR STRETCHING OF THE SPINE

BACKGROUND

The embodiments herein relate generally to pain relief and stretching, and more particularly, to a stretching belt for stretching the spine and muscle groups to relieve back pain and promote neutral posture.

The human spine should resemble an S curve when it is in neutral balance with normal vertebral discs. However, due to a number of influences, the spine and discs can lose its natural neutral curve, causing pain and loss in range of movement, particularly when a disc loses volume or becomes herniated or bulging. The conditions that influence the spine and vertebral discs negatively can include excessive sitting and driving, bending and twisting while lifting objects, and excessive standing with repetitive movement, such as a checkout clerk or assembly line at work. The spine can be drawn out of neutral balance also when connected muscle groups tighten or spasm due to stress, overuse, and lack of stretching. The iliopsoas and abdominal muscle groups connect directly to the lumbar region of the spine with the pelvis and femur bones. So, when they experience stiffness, soreness, tightening, or spasms, they can directly change the curve in the human spine and, thus, introduce pain when nerves become pinched or contorted as they exit through the vertebral disc pathways.

Proper alignment of the spine is known to reduce back pain. Conventional methods for aligning the spine include going to a chiropractor or trying to sufficiently stretch the spine. However, adequate stretching of the spine is not easily achieved. A compression belt may be used to alleviate back pain; however, compression belts fail to stretch and align the spine. Moreover, compression belts only provide some relief to back pain when worn; they do not alleviate any back pain when not being physically worn by the user. Therefore, a conventional compression belt is only a temporary solution to lower back pain.

Therefore, what is needed is a device for stretching the spine and promoting neutral posture and pandiculation, which is recognized as a natural way to return the human form to a neutrally balanced state.

SUMMARY

Some embodiments of the present disclosure include a stretching device for stretching and aligning a user's back. The device may include a belt, optionally a gambrel and universal hook, and optionally a support system, such as a slotted door mount. The belt may be designed to wrap around the user's back and under the user's armpits, wherein the belt is a segmented belt having a plurality of raised segments spaced along a length of the belt to facilitate a gripping action and structural integrity to comfortably suspend the torso while maintaining the correct lumbar curve. Rings may be attached to each end of the belt, wherein the rings may be designed to engage with a mounting device, such as the gambrel and universal hook.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
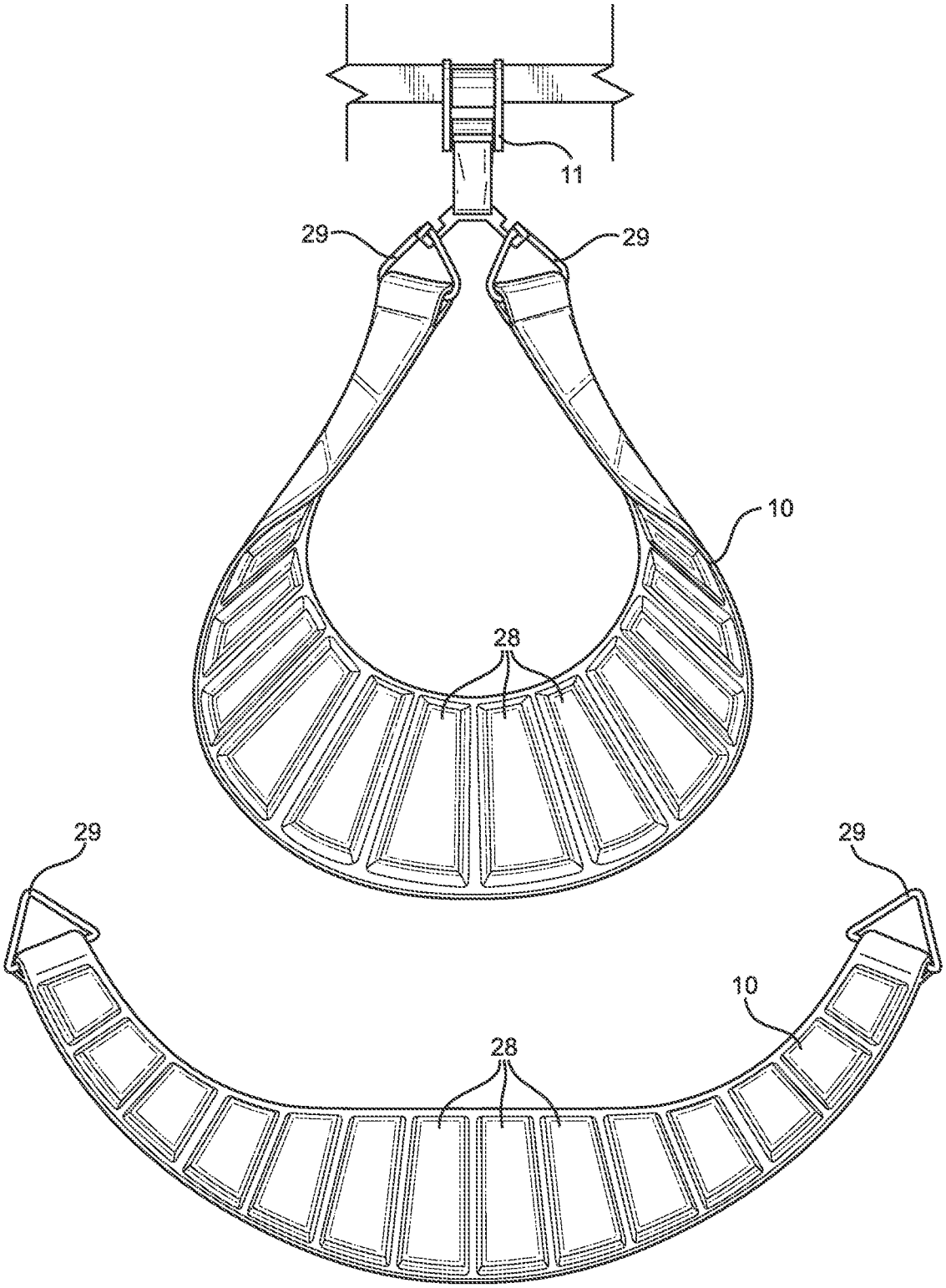
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to stretch and align a user's spine using gravity and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Segmented Belt
2. Layered Construction
3. Rings
4. Universal Hook
5. Gambrel and Strap The various elements of the stretching device for stretching and aligning a user's spine of the present disclosure may be related in the following exemplary fashion. It is not intended to limit the scope or nature of the relationships between the various elements and the following examples are presented as illustrative examples only.

By way of example, and referring to FIGS. 1-10, some embodiments of the device of the present disclosure comprise a belt 10 configured to partially encircle a user's torso, such that the belt 10 wraps around a user's back and under the user's armpits, the belt 10 comprising two ends, wherein each end comprises a ring 29 configured to engage with, for example, a hook, such as a forked gambrel 12, such that the user may place the belt 10 around his or her torso and allow the belt 10 to hold the individual above the ground, thus using gravity to stretch and align the spine. The belt 10 may create a gripping action due to the structure of the belt 10, wherein the gripping action may be increased or decreased depending on the amount of weight placed on the belt 10, creating more or less tightening around the body and stretching of the spine. The device may further comprise a forked gambrel 12 designed to engage with ends of the belt 10 such that the belt 10 is forced into a funnel shape during use. The device may also further comprise a universal hook 11 with a webbing strap 13 designed to engage with the gambrel 12 to mount the belt 10 to a device, such as a slotted doorway mount 15, a pull up bar 16, a hook mount 17, or the like.

Figure 2:
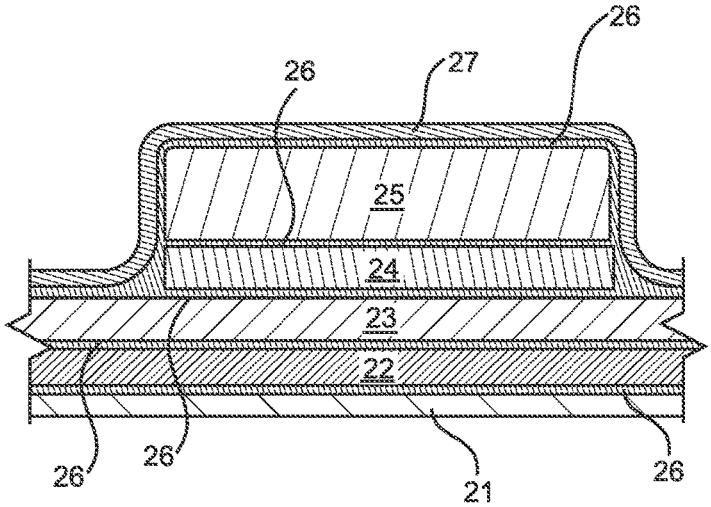
FIG. 2 is a cross section view of one embodiment of the present disclosure.

As shown in the Figures, the belt 10 may be a segmented belt comprising a plurality of segments 21 spaced along a length of the belt 10. The overall belt 10 may have a layered construction, as shown in FIG. 2, and each segment 28 may include additional layers, causing the segments 21 to protrude outward from the belt 10. For example, the belt 10 may include the following layers, in order, an outer protective material layer 21 designed to be positioned away from the user, a first adhesive layer 26, a fabric backing layer 22, a second adhesive layer 26, a mesh layer 23, a third adhesive layer 26, and an outer gripping layer 27 designed to be positioned against the user. Each segment 28 may be formed by adding additional layers between the third adhesive layer 26 and the outer gripping layer 27. Specifically, the segment 28 may be formed by adding a plastic layer 24 a fourth adhesive layer 26, a foam layer 25, and a fifth adhesive layer 26 between the third adhesive layer 26 and the outer gripping layer 27. While the materials used to create each layer may vary, in some embodiments, the outer protective layer may comprise a protective vinyl, the mesh layer may comprise a polypropylene mesh, the plastic layer may comprise an orthopedic plastic, the foam layer may comprise a neoprene foam, and the outer gripping layer may comprise a tactical grip rubber. As a result of this layered construction, the belt 10 is a hi-tech composite of materials that create a semi-rigid advanced structure to accurately support the lumbar curve in three dimensional planes while in gravity suspension. While it is described above that the layers may be adhered together using multiple adhesive layers 26, the layers may be attached together using any known fastener or connecting means.

As shown in FIG. 1, the belt 10 may have a rounded U shape, wherein the central portion of the device may be configured to align with a central portion of a user's back. For example, as shown in the Figures, the belt 10 may be configured to wrap around a thoracic area of the user's back, wherein, as a result of gravity pulling the user down, the belt 10 may suspend the user's upper body above the lumbar area from the effects of gravity, thus producing a stretching action to the lumbar area of the spine and the attached muscle groups. This stretching action also causes the pelvis to rotate to a neutral angle due to the muscle groups shared with the lumbar vertebrae and pelvic bone. From the central portion, the device may curve downward, creating an allowance and comfortable fit for a user's armpits when the device is in use, such that the belt 10 may avoid direct contact with a user's armpits in favor of an overall gripping of the torso.

As shown in FIG. 1, each end of the belt 10 may comprise a ring 29, such as triangular shaped ring. The ring 29 may be attached to the belt 10 using any known fastener or fastening method and, in some embodiments, each ring 29 may be double-stitched into the ends of the belt by folding excess material through the ring 29. Each ring 29 may be further secured to the belt using a sleeve (not shown), which may be pulled over the rings 29, wherein the rings 29 extend through an orifice in the sleeve. In some embodiments, each sleeve may comprise an elastic material and may be adhered or otherwise attached to the belt.

Figure 3:
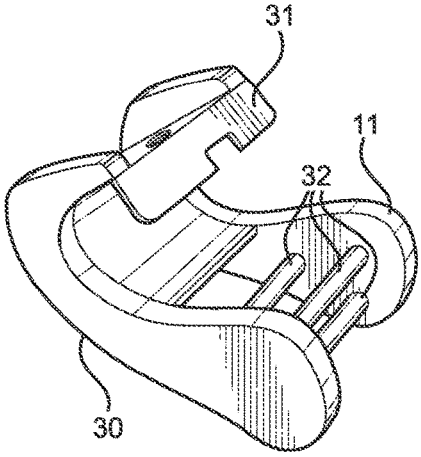
FIG. 3 is a perspective view of the universal hook portion of the present disclosure.
Figure 9:
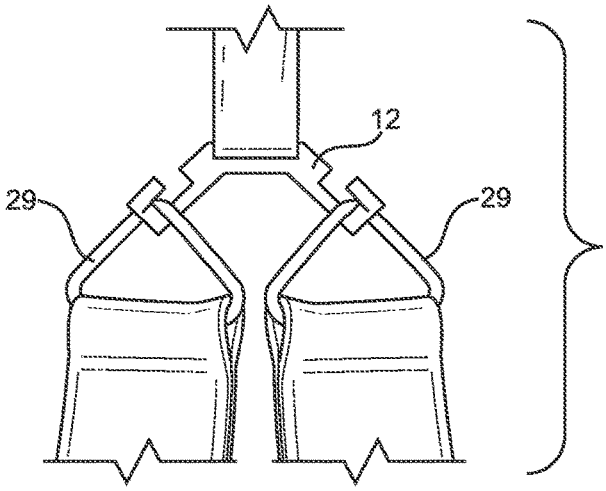
FIG. 9 is a close-up front view of the gambrel portion of the present disclosure.
Figure 10:
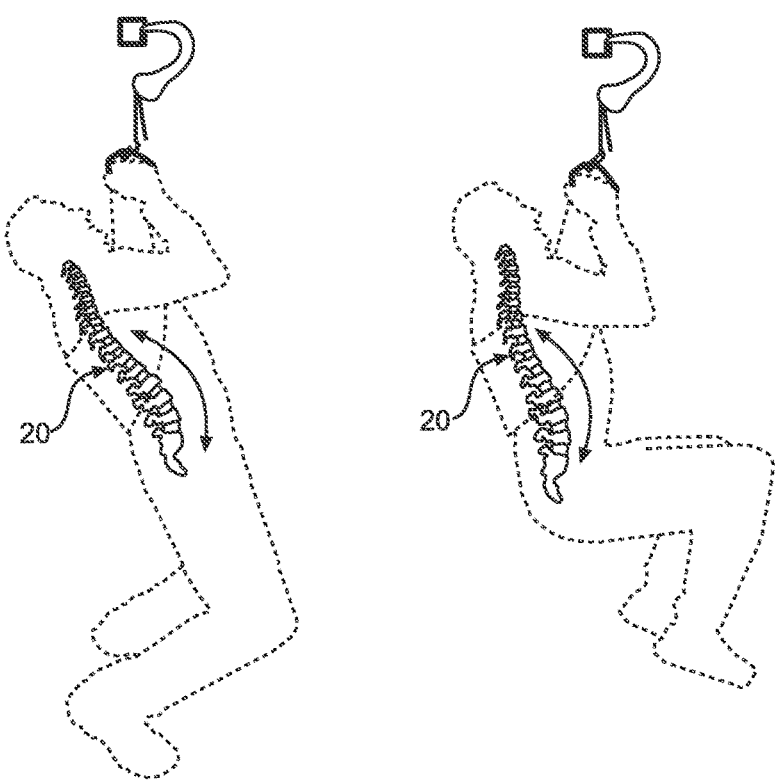
FIG. 10 is a perspective view of one embodiment of the present disclosure, shown in use.

As shown in, for example, FIGS. 1 and 9, the rings 29 may removably engage with a forked gambrel 12. As shown, the forked gambrel 12 may comprise a pair of arms extending at an angle from a central portion of the gambrel 12. The end of each arm may be substantially hook shaped to prevent the rings 29 from slipping off of the gambrel 12 during use. A webbing strap 13 may extend from the forked gambrel 12 and may removably engage with a fastener or mounting device, such as the universal hook 11. The universal hook 11 may comprise a pair of curved sides 30, a tab 31 extending between the pair of curved sides 30 at a first end thereof, and a plurality of crossbars 32 extending between the pair of curved sides 30 at a second end thereof. For example, the universal hook 11 may comprise three crossbars 32 positioned in a substantially triangular orientation to provide a secure mechanism to suspend the user with adjustable distances of the gambrel 12 to the floor, as shown in FIG. 3. The webbing strap 13 may be wrapped around the crossbars 32 to secure the gambrel 12 to the universal hook 11.

Figure 4:
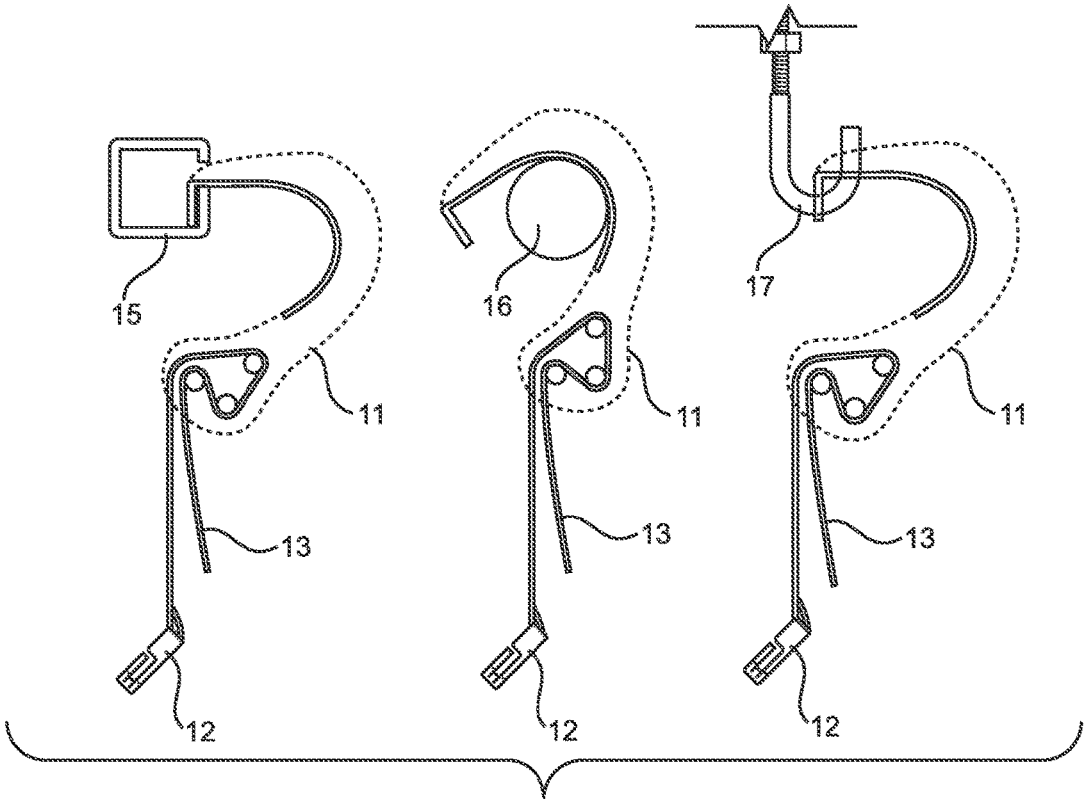
FIG. 4 is an interior side view of the universal hook portion of the present disclosure.

As mentioned above, the universal hook 11 may be designed to removably engage with a mounting device to secure the device of the present disclosure to a structure. For example, and as shown in FIG. 4, the universal hook 11 may engage with either a slotted door mount 15, a pull-up bar 16, a hook mount 17, or the like. To engage with a pull-up bar 16, curved sides 30 may simply be placed over the pull-up bar, as seen in FIG. 4. To engage with a hook mount 17, a notch in the tab 31 may be placed over a bottom of the curved section of the hook mount 17, and the free end of the hook mount 17 may pass through an orifice in the universal hook 11.

Figure 5:
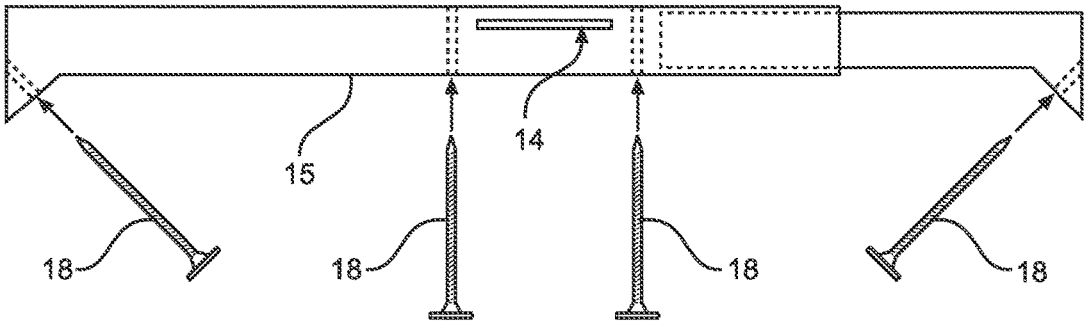
FIG. 5 is a front view of the slotted doorway mount portion of the present disclosure.
Figure 6:
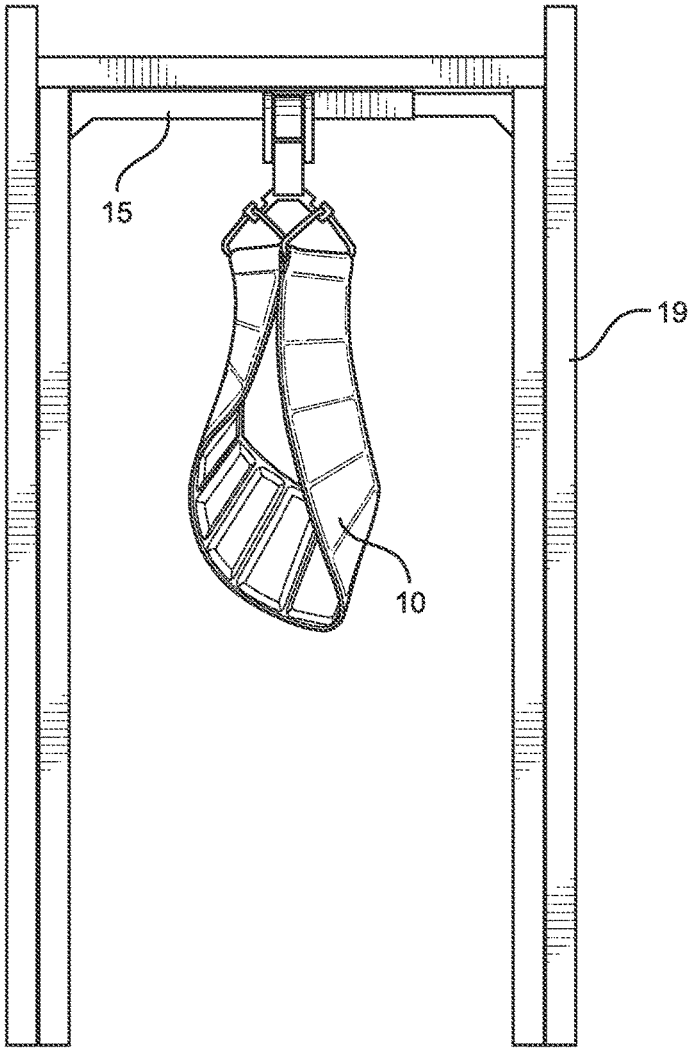
FIG. 6 is a front view of one embodiment of the present disclosure, shown installed in a doorway.
Figure 7:
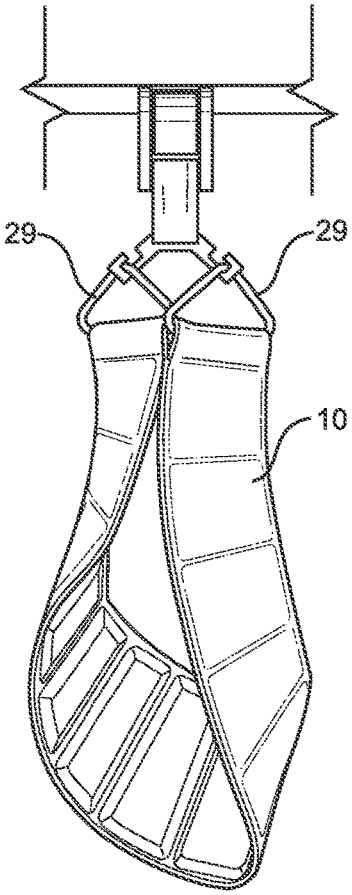
FIG. 7 is a perspective view of one embodiment of the present disclosure.
Figure 8:
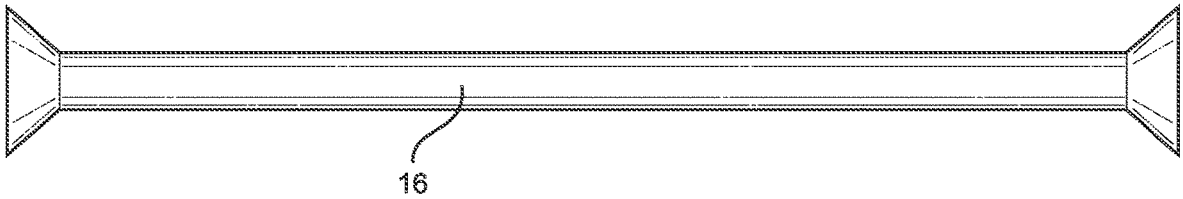
FIG. 8 is a front view of a pull-up bar.

As shown in FIGS. 5 and 6, the slotted door mount 15 may comprise a substantially elongate hollow tube. In some embodiments, the slotted door mount 15 may have an adjustable length, wherein the elongate hollow tube comprises a pair of telescoping tubes. Each end of the elongate hollow tube may comprise an angled end. A slot 14 may extend through a sidewall of the elongate hollow tube, as shown in FIG. 5. In embodiments, the hollow tube may have a square cross-section. Lastly, the elongate hollow tube may comprise a plurality of fastener orifices extending therethrough, wherein the fastener orifices are sized to accommodate a fastener, such as a screw 18, engaged therewith to attach the slotted door mount 15 to the door frame 19. To engage the universal hook 11 with the slotted door mount 15, the tab 31 may simply be inserted into the slot 14 in the slotted door mount 15.

For clarification purposes, the belt 10 may function in a manner similar to a Chinese finger trap, wherein tightening is caused by pulling on the device. Specifically, the webbing material layer 16 may have warp and weft threads, wherein when the webbing material layer 16 is pulled on due to gravity pulling the user's body downward, the angle between the warp and weft threads and their crossing points may be reduced. The more gravity tension applied to the belt, the more the webbing material layer 16 may tighten.

The stretching device of the present disclosure may be used as follows. A user may wrap the belt 10 around the user's back and under the armpits. While in a standing position, the rings 29 may be attached to a mounting device, such as the forked gambrel 11, wherein the mounting device is attached to a support system, such as a pull-up bar 16, a slotted door mount 15, or a hook fastener 17. When using the forked gambrel 11, the rings 29 may be forced to form the belt 10 into a funnel-shape. The user may then bend at the knees, allowing the belt 10 to hold the user from the ground. The gravity from the individual's lower body may stretch the spine 20 and connected tendons and muscles. The stretching action may promote the vertebrae to naturally stretch along the spine 20 without straightening the natural lumbar curvature. Thus, the stretching device may provide sufficient strength, stiffness, stretch, and comfort to promote relaxation while maintaining a neutral lumbar curvature, which may be key to promoting vertebrae alignment while stretching. Stretching and alignment may be achieved immediately or almost immediately, such as within about 30 seconds to within about a minute.

The stretching device of the present disclosure may promote neutral posture with repeated use by training the body to the correct lumbar curve, while aligning the spine in 3 dimensional planes. The pelvis may adopt a neutral rotation when the torso is suspended with the correct lumbar curve. Stretching and strengthening the iliopsoas and abdominal muscle groups that connect the lumbar vertebrae to the pelvic bone structure may relieve muscle spasms and potential scoliosis and sciatica symptoms by resetting muscle tension thought regular use, combining stretch, pull-up, relaxation, and breathing techniques.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A stretching device for stretching and aligning a user's back, the stretching device comprising:

a belt configured to wrap around the user's back and under the user's armpits, wherein the belt is a segmented belt comprising a plurality of raised segments spaced along a length of the belt;

a first ring attached to a first end of the belt and a second ring attached to a second end of the belt; and a hook operatively engaged with the belt, the hook designed to removably engage with a support system, wherein the hook comprises:

a pair of curved sides, each curved side of the pair of curved sides is formed by a continuous curvature formed by concave and convex curvatures; and a plurality of crossbars extending between the pair of curved sides at a second end thereof, wherein:

the first ring and the second ring are configured to engage with a mounting device; and the mounting device is configured to engage with the hook, which is configured to engage with the support system.

2. The stretching device of claim 1, wherein:

the belt has a layered construction; and each segment of the plurality of raised segments comprises additional layers, causing each of the segments to protrude outward from the belt.

3. The stretching device of claim 2, wherein the layered construction comprises, in order:

an outer protective material layer designed to be positioned away from the user;

a fabric backing layer;

a mesh layer; and an outer gripping layer designed to be positioned against the user.

4. The stretching device of claim 3, wherein each segment of a plastic layer and a foam layer placed between the mesh layer and the outer gripping layer.

5. The stretching device of claim 4, wherein:

the outer protective layer comprises a protective vinyl;

the mesh layer comprises a polypropylene mesh;

the plastic layer comprises a plastic;

the foam layer comprises a neoprene foam; and the outer gripping layer comprises a rubber.

6. The stretching device of claim 4, wherein an adhesive layer is placed between adjacent layers in the belt and each segment of the plurality of raised segments.

7. A stretching device for stretching and aligning a user's back, the stretching device comprising:

a layered belt configured to wrap around the user's back and under the user's armpits, wherein the layered belt is a segmented belt comprising a plurality of raised segments spaced along a length of the belt, each segment of the plurality of segments having a layered construction; and a first ring attached to a first end of the belt and a second ring attached to a second end of the belt;

a forked gambrel removably engaged with each of the first ring and the second ring; and a hook removably engaged with the forked gambrel, the hook designed to removably engage with a support system, wherein the hook comprises:

a pair of curved sides, wherein each curved side of the pair of curved sides is formed by a continuous curvature formed by concave and convex curvatures; and a plurality of crossbars extending between the pair of curved sides at a second end thereof.

8. The stretching device of claim 7, wherein the hook further comprises:

a tab extending between the pair of curved sides at a first end thereof.

9. The stretching device of claim 8, wherein:

the forked gambrel is attached to a strap; and the strap removably engages with the plurality of crossbars, securing the forked gambrel to the hook.

10. The stretching device of claim 7, wherein:

the layered construction comprises, in order:

an outer protective material layer designed to be positioned away from the use;

a fabric backing layer;

a mesh layer; and an outer gripping layer designed to be positioned against the user; and a plastic layer and a foam layer placed between the mesh layer and the outer gripping layer.

11. A stretching device for stretching and aligning a user's back, the stretching device comprising:

a layered belt configured to wrap around the user's back and under the user's armpits, wherein the layered belt is a segmented belt comprising a plurality of raised segments spaced along a length of the belt, each segment of the plurality of raised segments having a layered construction;

a first ring attached to a first end of the belt and a second ring attached to a second end of the belt;

a forked gambrel removably engaged with each of the first ring and the second ring;

a hook removably engaged with the forked gambrel, the hook comprising:

a pair of curved sides, wherein each curved side of the pair of curved sides is formed by a continuous curvature formed by concave and convex curvatures; and a plurality of crossbars extending between the pair of curved sides at a second end thereof; and a slotted door mount removably engaged with the hook and designed to be mounted in a doorway.

12. The stretching device of claim 11, wherein the hook further comprises:

a tab extending between the pair of curved sides at a first end thereof.

13. The stretching device of claim 12, wherein the slotted door mount comprises:

a substantially elongate hollow tube with an adjustable length and angled ends; and a slot extending through a sidewall of the elongate hollow tube, the slot sized to engage with the tab on the hook.

* * * * *